US007535445B2

(12) United States Patent
Jang

(10) Patent No.: US 7,535,445 B2
(45) Date of Patent: May 19, 2009

(54) LIQUID CRYSTAL DISPLAY DEVICE AND DRIVING METHOD THEREOF

(75) Inventor: Yong Ho Jang, Gwachun-shi (KR)

(73) Assignee: LG. Display Co., Ltd., Seoul (KR)

( * ) Notice: Subject to any disclaimer, the term of this patent is extended or adjusted under 35 U.S.C. 154(b) by 732 days.

(21) Appl. No.: 10/988,906

(22) Filed: Nov. 15, 2004

(65) Prior Publication Data

US 2005/0122304 A1 Jun. 9, 2005

(30) Foreign Application Priority Data

Dec. 8, 2003 (KR) ..... 10-2003-0088648

(51) Int. Cl.
*G09G 3/36* (2006.01)

(52) U.S. Cl. ..... 345/87; 345/90; 345/92; 345/98; 345/100

(58) Field of Classification Search ..... 345/87–104, 345/690–699, 204–215

See application file for complete search history.

(56) References Cited

U.S. PATENT DOCUMENTS 6,825,822 B2 * 11/2004 Lee ..... 345/87
2003/0030609 A1 2/2003 Lee

OTHER PUBLICATIONS

Office Action dated Apr. 6, 2007 for corresponding Chinese Patent Application No. 2004100917036.

* cited by examiner

*Primary Examiner*—Vijay Shankar
(74) *Attorney, Agent, or Firm*—Brinks Hofer Gilson & Lione

(57) ABSTRACT

A liquid crystal display device and a driving method thereof is presented in which a first liquid crystal cell is provided at one side of the data line, and a second liquid crystal cell is provided at the other side thereof. A first switching part is provided for each first liquid crystal cell positioned at an ith horizontal line (wherein i is an integer) to be controlled by the (i−1)th gate line and the ith gate line. A second switching part is provided for each second liquid crystal cell positioned at an ith horizontal line to be controlled by the ith gate line.

17 Claims, 8 Drawing Sheets

LIQUID CRYSTAL DISPLAY DEVICE AND DRIVING METHOD THEREOF

PRIORITY CLAIM

This application claims the benefit of Korean Patent Application No. 2003-88648 on Dec. 8, 2003, which is incorporated herein by reference.

BACKGROUND

1. Technical Field

This application relates to a liquid crystal display, and more particularly to a liquid crystal display device and a driving method thereof that may reduce the number of data lines as well as the number of data drive integrated circuits corresponding thereto.

2. Related Art

A liquid crystal display (LCD) controls a light transmittance of a liquid crystal using an electric field to thereby display a picture. The LCD includes a liquid crystal display panel having a pixel matrix, and a driving circuit for driving the liquid crystal display panel. The driving circuit drives the pixel matrix such that picture information can be displayed on the display panel.

FIG. 1 shows a related art liquid crystal display device, which includes a liquid crystal display panel 2, a data driver 4 for driving data lines DL1 to DLm of the liquid crystal display panel 2, and a gate driver 6 for driving gate lines GL1 to GLn of the liquid crystal display panel 2.

The liquid crystal display panel 2 is comprised of thin film transistors (TFT), each of which is provided at each intersection between the gate lines GL1 to GLn and the data lines DL1 to DLm, and liquid crystal cells connected to the TFTs and arranged in a matrix configuration.

The gate driver 6 sequentially applies a gate signal to each gate line GL1 to GLn in response to a control signal from a timing controller (not shown). The data driver 4 converts data R, G and B video data from the timing controller into analog video signals and applies the analog video signals for one horizontal line to the data lines DL1 to DLm during one horizontal period when a gate signal is applied to the corresponding gate line GL1 to GLn.

The thin film transistor (TFT) applies a data from the data lines DL1 to DLm to the liquid crystal cell in response to a control signal applied to the gate lines GL1 to GLn. The liquid crystal cell can be equivalently expressed as a liquid crystal capacitor Clc because it is comprised of a common electrode a pixel electrode opposed to each other, having a liquid crystal therebetween. Such a liquid crystal cell includes a storage capacitor (not shown) connected to a preceding gate line in order to keep a data voltage charged in the liquid crystal capacitor Clc until the next time the data voltage is applied thereto.

The liquid crystal cells of such a related art LCD arranged in vertical lines whose number equals the number (i.e., m) of the data lines DL1 to DLm as they are provided at intersections between the gate lines GL1 to GLn and the data lines DL1 to DLm. That is, the liquid crystal cells are arranged in a matrix configuration in such a manner to make m vertical lines and n horizontal lines.

Accordingly, the related art LCD requires m data lines DL1 to DLm so as to drive the liquid crystal cells having m vertical lines. Therefore, the related art LCD has a drawback in that a number of data lines m are required to drive the liquid crystal display panel 2. Furthermore, the related art LCD has a disadvantage in that a large number of data driving integrated circuits (IC's) must be included in the data driver 4 so as to drive the m data lines, resulting in an undesirable manufacture cost.

SUMMARY

A liquid crystal display device includes a plurality of data lines; a plurality of gate lines arranged in a direction crossing the data lines; a first liquid crystal cell provided at one side of each data line; a second liquid crystal cell provided at an other side of each data line, the liquid crystal cells being disposed parallel to the gate lines; a first switching means provided for each first liquid crystal cell positioned at an ith horizontal line (wherein i is an integer) to be controlled by the (i−1)th gate line and the ith gate line; and a second switching means provided for each second liquid crystal cell positioned at an ith horizontal line to be controlled by the ith gate line, the gate lines being associated with corresponding horizontal liquid crystal cell lines.

In the liquid crystal display device, the first switching means, positioned at the ith horizontal line, applies a video signal supplied to the data line to the first liquid crystal cell when the (i−1)th gate line and the ith gate line are in a low state after they had previously been supplied with high gate signals. Unless specifically mentioned, the term gate signal means the high gate or gate ON state.

The second switching means, positioned at the ith horizontal line, applies a video signal supplied to the data line to the second liquid crystal cell when gate signals are supplied to the ith gate line and the (i+1)th gate line.

The first liquid crystal cell and the first switching means may be located at the left side of the data lines, and the second liquid crystal cell and the second switching means may be located at the right side of the data lines.

Alternatively, the first liquid crystal cell and the first switching means may be located at the right side of the data lines and the second liquid crystal cell and the second switching means may be located at the left side of the data lines.

The first switching means may be comprised of three-terminal devices or other switch circuits, acting as a single-pole single-throw switch in accordance with the state of a voltage applied to a control terminal. In an aspect, the first switching means may comprise a first switch, having a first switch terminal connected to the data line, and a second switch terminal connected to the first liquid crystal cell; and a second switch having a first switch terminal connected to the (i−1)th gate line, the second switch terminal connected to the control terminal of the first switch, and the control terminal of the second switch connected to the ith gate line.

In another aspect, the first switching means may include a first thin film transistor having a source terminal connected to the data line and a drain terminal connected to the first liquid crystal cell; and a second thin film transistor having a drain terminal connected to a gate terminal of the first thin film transistor, a gate terminal connected to the ith gate line and a source terminal connected to the (i−1)th gate line.

Generally, the source and drain terminals of any of the thin film transistors may be interchanged without affecting the operation of the apparatus. For simplicity of discussion, this fact may not be repeated in the remainder of the application, but the specification should be interpreted to incorporate this meaning.

The second switching means may be comprised of a three-terminal device or other switch circuit, acting as a single-pole single-throw switch in accordance with the state of a voltage applied to a control terminal. In an aspect, the second switching means may comprise a switch, having a first switch terminal connected to the data line, and a second switch terminal connected to the second liquid crystal cell, and the control element connected to the ith gate line.

In another aspect, the second switching means may a third thin film transistor having a source terminal connected to the data line, a gate terminal connected to the ith gate line and a drain terminal connected to the second liquid crystal cell.

The liquid crystal display device may further include a gate driver for sequentially applying first and second gate signals to the gate lines such that said second gate signal applied to the (i−1)th gate line rises simultaneously with said first gate signal applied to the ith gate line, and said first gate signal has a smaller time duration than said second gate signal.

The first and second thin film transistors positioned at the ith horizontal line are turned on when said first and second gate signals are simultaneously applied to the (i−1)th and ith gate lines, and the gate terminal of the second thin film transistor may have a floating state when the first and second gate signal are inverted into a low state, thereby maintaining the second thin film transistor in an ON condition.

When the first thin film transistor is in an ON state, during the period following the end of the period where the first and second gate signals were applied to the gate lines such that said second gate signal is applied to the (i−1)th gate line and said first gate signal is applied to the ith gate line, a desired video signal may be applied to the first liquid crystal cell connected to the first thin film transistor.

In another aspect, the liquid crystal display device may further include a capacitor connected to the gate terminal of the first thin film transistor such that the first thin film transistor can stably keep a turn-on state when the gate terminal of the first thin film transistor is placed into said floating state.

In yet another aspect, a liquid crystal display device includes a plurality of data lines; a plurality of gate lines arranged in a direction crossing the data lines; a first liquid crystal cell provided at one side of each data line; a second liquid crystal cell provided at an other side of each data line, the liquid crystal cells being disposed parallel to the gate lines; a first switching means provided for each first liquid crystal cell positioned at an ith horizontal line (wherein i is an integer) to be controlled by the (i−1)th gate line and the ith gate line; and a second switching means provided for each second liquid crystal cell positioned at an ith horizontal line to be controlled by the ith gate line, wherein the first switching means and the second switching means are arranged in a zigzag configuration with respect to each data line.

In even-numbered horizontal lines, the first liquid crystal cell and the first switching means may be located at the left-hand side of each vertical line while the second liquid crystal cell and the second switching means may be located at the right-hand side of each vertical line. In odd-numbered horizontal lines, the first liquid crystal cell and the first switching means may be located at the right-hand side of each vertical line while the second liquid crystal cell and the second switching means may be located at the left-hand side of each vertical line. It should be understood that the designation of lines as odd and even may start with a numbering system of either zero or one. That is, an odd numbered line differs by odd number from an even numbered line. The indexing system used in the discussion can be used to describe the relationship between differing lines, whether an odd or even number is used as the base line.

In yet another aspect, a method of driving a liquid crystal display device includes, providing first and second liquid crystal cells, first switching means having first and second thin film transistors to drive the first liquid crystal cell and second switching means having a third thin film transistor to drive the second liquid crystal cell; applying a desired video signal to the first liquid crystal cell provided at an ith horizontal line (wherein i is an integer) when the (i−1)th gate line and the ith gate line are inverted into a low state after they had previously been supplied with gate signals; and applying said desired video signal to the second liquid crystal cell provided at the ith horizontal line when gate signals are supplied to the ith gate line and the (i+1)th gate line.

In the method, the step of applying the desired video signal to the first liquid crystal cell includes turning on the second thin film transistor in response to a gate signal applied to the ith gate line; turning on the first thin film transistor in response to a gate signal applied to the (i−1)th gate line when the second thin film transistor is turned on; turning off the second thin film transistor when the ith gate line and the (i−1)th gate line are inverted into a low state, where the ith gate is inverted prior to the (i−1)th gate, thus floating the first thin film transistor gate when the second thin film transistor is turned off, thereby allowing the first thin film transistor to maintain an ON state.

Applying the desired video signal to the second liquid crystal cell includes turning on the third thin film transistor in response to a gate signal applied to the ith gate line when the ith gate line and the (i+1)th gate line are supplied with gate signals.

DETAILED DESCRIPTION

Exemplary embodiments of the invention may be better understood with reference to the drawings, but these embodiments are not intended to be of a limiting nature. Rather, the invention is to cover all modifications, equivalents, and alternatives falling within the spirit and scope of the invention which is set forth by the claims.

Figure 2:
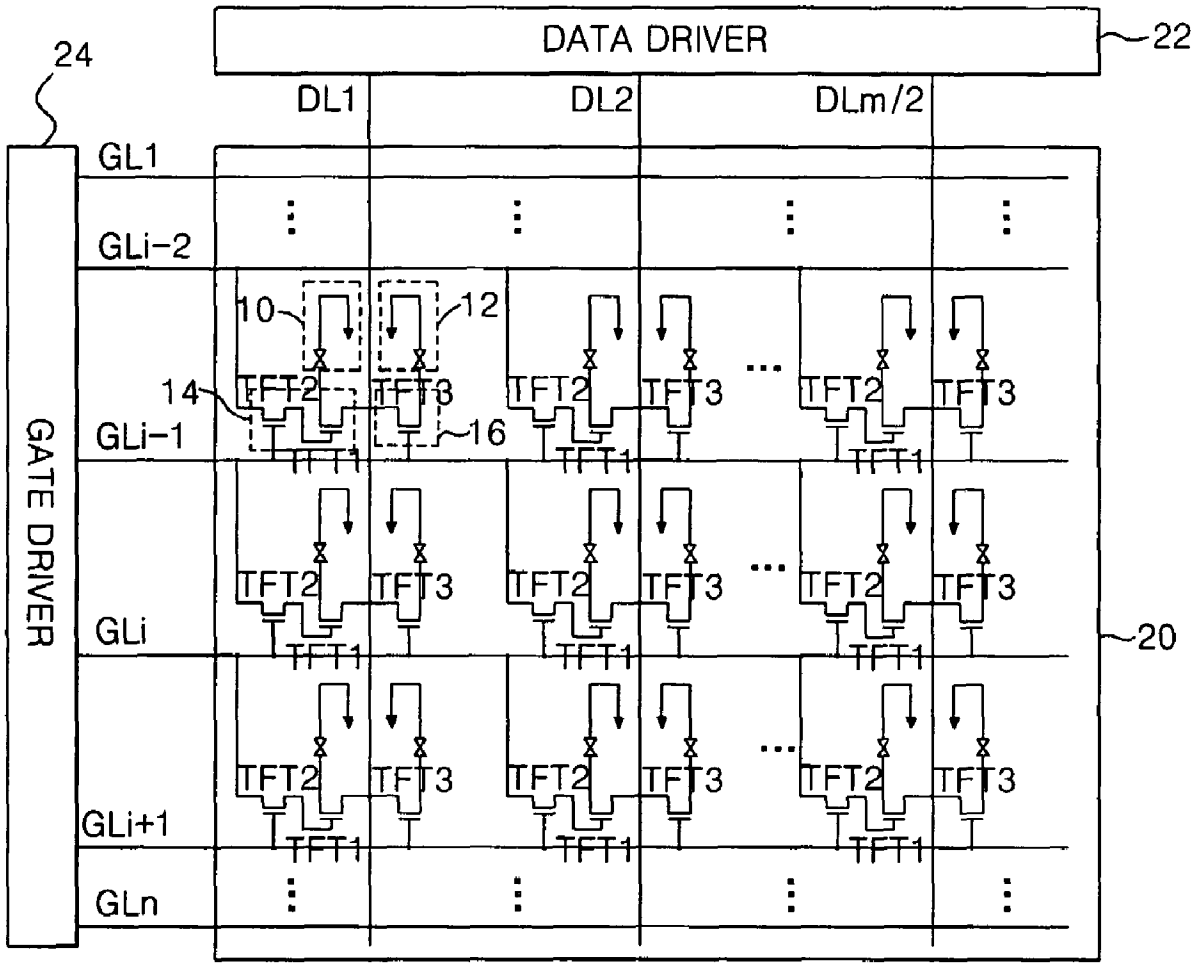
FIG. 2 is a block circuit diagram showing a configuration of a liquid crystal display according to a first embodiment.

FIG. 2 schematically shows a liquid crystal display (LCD) according to a first embodiment, where the LCD includes a liquid crystal display panel 20, a data driver 22 for driving data lines DL1 to DLm/2 of the liquid crystal display panel 20, and a gate driver 24 for driving gate lines GL1 to GLn of the liquid crystal display panel 20.

The liquid crystal display panel 20 is comprised of first and second liquid crystal cells 10 and 12 provided at intersections between the gate lines GL1 to GLn and the data lines DL1 to DLm/2, a first switching part 14 for driving the first liquid crystal cell 10, and a second switching part 16 for driving the second liquid crystal cell 12.

The first and second liquid crystal cells 10 and 12 can be electrically represented as a liquid crystal capacitor Clc as they are comprised of a common electrode opposed to a pixel electrode having a liquid crystal therebetween. Each of the first and second liquid crystal cells 10 and 12 further includes a storage capacitor (not shown) connected to a preceding gate line, or to a common electrode, in order to maintain the data voltage applied to the liquid crystal capacitor Clc until the next time that a video data voltage is applied thereto.

Figure 1:
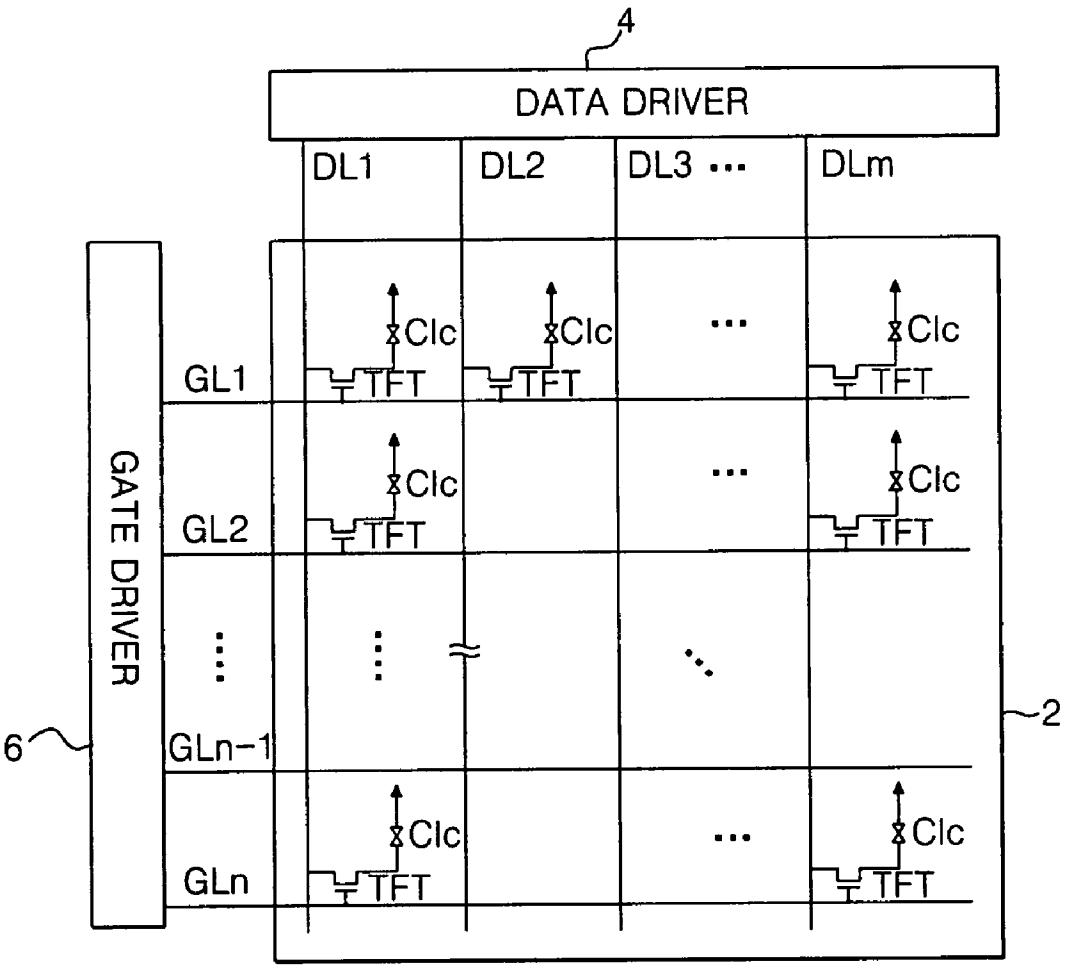
FIG. 1 RELATED ART
FIG. 1 is a block circuit diagram showing a configuration of a related art liquid crystal display.

The first liquid crystal cell 10 and the first switching part 14 may be provided at the left side of the data line DL. The second liquid crystal cell 12 and the second switching part 16 may be provided at the right side of the data line DL. That is, the first and second liquid crystal cells 10 and 12 are provided at the left and right sides of a single data line DL. In this case, both the first and second liquid crystal cells 10 and 12 positioned in this manner receive video signals from the same adjacent data line DL. Thus, the LCD according to the first embodiment allows the number of data lines DL to be reduced to one half of that in the related art LCD shown in FIG. 1.

Figure 4:
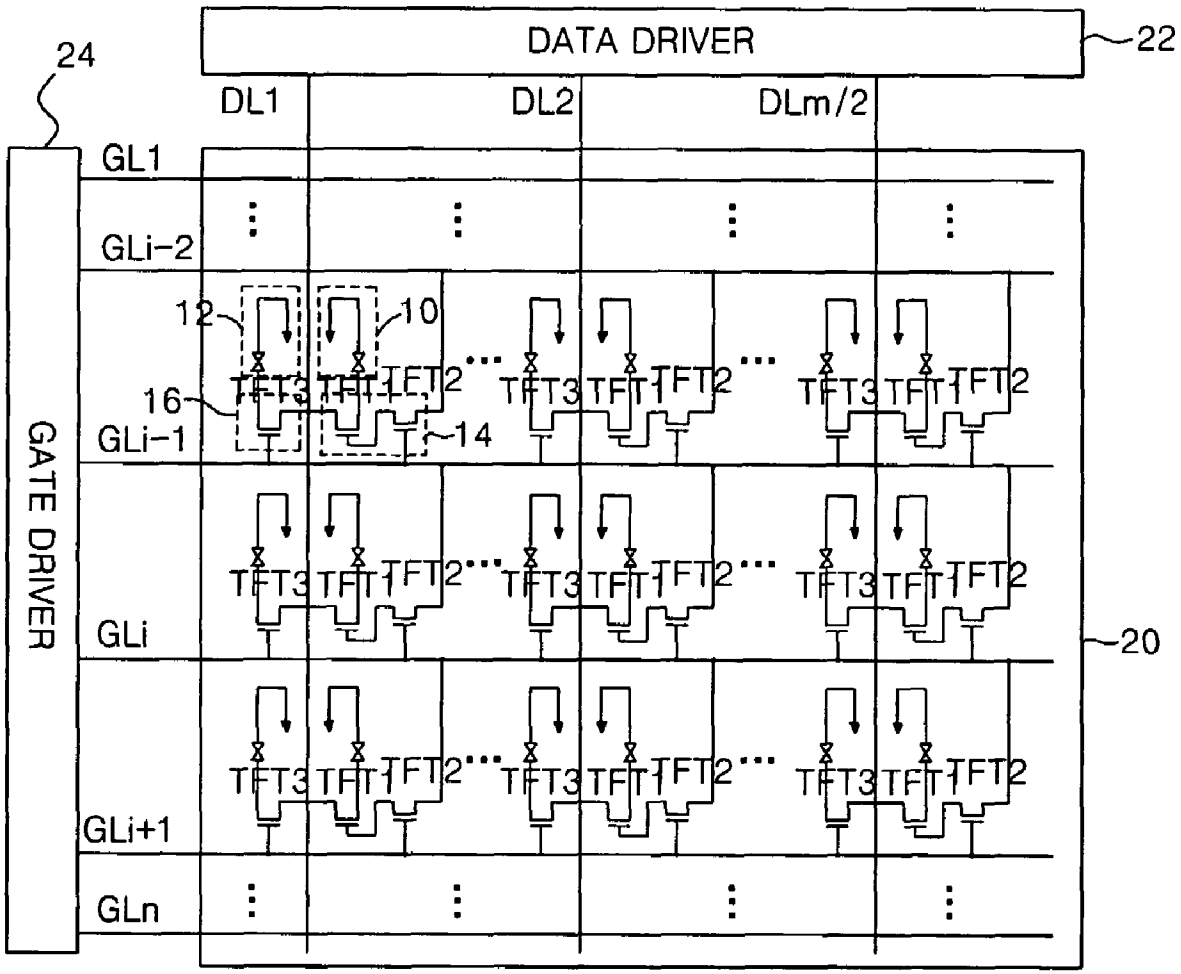
FIG. 4 is a block circuit diagram showing a configuration of a liquid crystal display according to a second embodiment.

In a second embodiment, a position of the first and second liquid crystal cells 10 and 12 may be interchanged as shown in FIG. 4. That is, the first liquid crystal cell 10 and the first switching part 14 may be provided at the right side of the data line DL while the second liquid crystal cell 12 and the second switching part 16 may be provided at the left side of the data line.

The first switching part 14 for driving the first liquid crystal cell 10 includes first and second thin film transistors TFT1 and TFT2. The source terminal of the second thin film transistor TFT2 is connected to the (i−1)th gate line GLi-1 while the gate terminal thereof is connected to the ith gate line GLi. The gate terminal of the first thin film transistor TFT1 is connected to the drain terminal of the second thin film transistor TFT2 while the source terminal thereof is connected to the adjacent data line DL. Further, the drain terminal of the first thin film transistor TFT1 is connected to the first liquid crystal cell 10. Such a first switching part 14 applies a video signal to the first liquid crystal cell 10 when the gate terminal of the first thin film transistor TFT1 is kept at a floating state in which a voltage is charged after the second thin film transistor is turned off.

The second switching part 16 for driving the second liquid crystal cell 12 includes a third thin film transistor TFT3. The gate terminal of the third thin film transistor TFT3 is connected to the ith gate line GLi while the source terminal thereof is connected to the adjacent data line DL. Further, the drain terminal of the third thin film transistor TFT3 is connected to the second liquid crystal cell 12. When a driving signal is applied to the ith gate line GLi, the second switching part 16 applies a video signal to the second liquid crystal cell 12.

Figure 3:
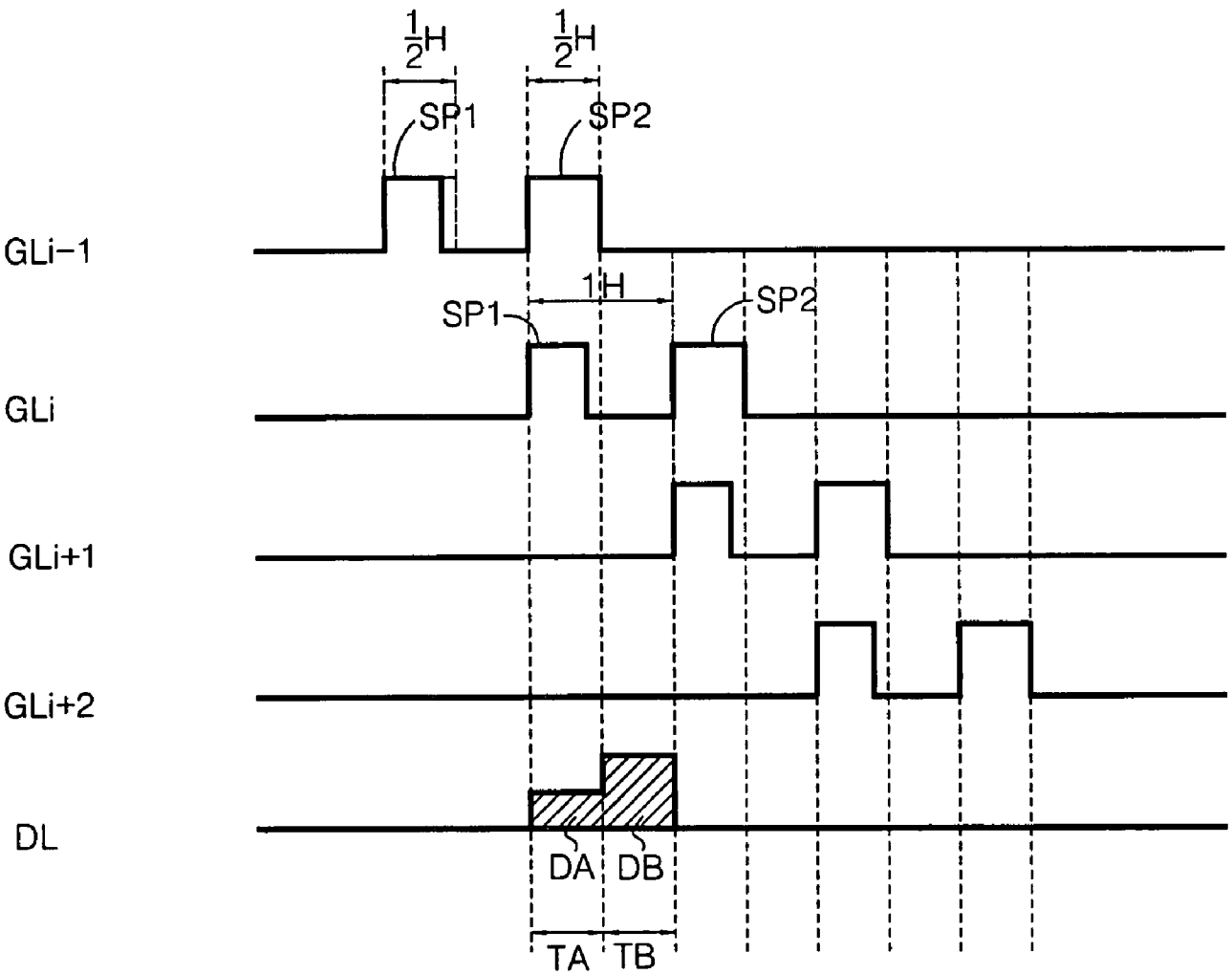
FIG. 3 is a waveform diagram of driving signals applied to the gate lines shown in FIG. 2.

The gate driver 24 applies first and second gate signals SP1 and SP2 to each gate line GL1 to GLn, as shown in FIG. 3, in response to a control signal from the timing controller (not shown). Herein, the first gate signal SP1 maintains a high state during a time interval smaller than a ½ horizontal period (½)H while the second gate signal SP2 maintains a high state during the same ½ horizontal period (½)H. Further, the second gate signal SP2 applied to the (i−1)th gate line GLi-1 is synchronous with, that is, rises at the same time with, the first gate signal SP1 applied to the ith gate line GLi. Thus, the first gate signal SP1 applied to the ith gate line GLi is transitions into a low state prior to the second gate signal SP2 applied to the (i−1)th gate line GLi-1. The terms "high state" and "low state" are meant as the voltages required to turn a switch element ON or OFF, respectively.

The data driver 22 converts data R, G and B from the timing controller into analog video signals and applies them to the data lines DL1 to DLm/2. In this case, the LCD according to the second embodiment allows the number of data lines DL1 to DLm/2 to be reduced to a half of that in the related art LCD shown in FIG. 1, so that the number of data drive IC's included in the data driver 22 may also be reduced.

A procedure in which video signals may be applied to the liquid crystal cells 10 and 12, comprises:

During a first period TA (i.e., (½)H), the second gate signal SP2 is applied to the (i−1)th gate line GLi-1 at the same time as the first gate signal SP1 is applied to the ith gate line GLi. The first gate signal SP1, applied to the ith gate line GLi, turns on the second and third thin film transistors TFT2 and TFT3 provided at the ith horizontal line. The second gate signal SP2 applied to the (i−1)th gate line GLi-1 turns on the first thin film transistor TFT1 via the second thin film transistor TFT2 provided at the ith horizontal line. Further, the second gate signal SP2 applied to the (i−1)th gate line GLi turns on the second and third thin film transistors TFT2 and TFT3 provided at the (i−1)th horizontal line.

If the second gate signal SP2 is applied to the (i−1)th gate line GLi-1, and the first gate signal SP1 is applied to the ith gate line GLi, then the second liquid crystal cell 12 provided at the (i−1)th horizontal line is connected to the data line DL. Further, if the second gate signal SP2 is applied to the (i−1)th gate line GLi-1 and the first gate signal SP1 is applied to the ith gate line GLi, then the first and second liquid crystal cell 10 and 12 provided at the (i−1)th horizontal line are connected to the data line DL. At this time, a video signal DA to be applied to the second liquid crystal cell 12 provided at the (i−1)th horizontal line is transferred into the data line DL. Thus, a desired video signal DA is charged in the second liquid crystal cell 12 provided at the (i−1)th horizontal line. At this time, a video signal DA (dummy video signal) also is charged in the first and second liquid crystal cells 10 and 12 provided at the ith horizontal line, The term "dummy video signal" implies that the video signal DA may be overwritten by video data at a later portion of the data transfer cycle.

During a second period TB (i.e., (½)H) after the first period TA, a gate signal is not applied to the gate lines GL. If a gate signal is not applied to the gate lines GL, then the second and third thin film transistors TFT2 and TFT3 provided at the ith horizontal line are turned off. At this time, the first thin film transistor TFT1 maintains an ON state due to the second gate signal SP2 which had been applied in the previous (½)H period (i.e., the first period TA). That is, since the gate terminal of the first thin film transistor TFT1 is now in a floating state, after having been supplied with the second gate signal, the first thin film transistor TFT1 maintains an ON state during the second period TB (even though the second thin film transistor TFT2 has been turned off). This occurs since the first gate signal SP1 applied to the ith gate line GLi transitions into a low state prior to the second gate signal SP2 which is applied to the (i−1)th gate line GLi-1 transitioning into a low state, with the result that the gate terminal of the first thin film transistor TFT1 may remains in a floated state corresponding to the second gate signal SP2 high state.

During such a second period TB, a video signal DB which may be applied to the first liquid crystal cell 10 disposed at the ith horizontal line may be applied to the data line DL. Thus, the video signal DB applied to the data line DL is applied, via the first thin film transistor TFT1 provided at the ith horizontal line, to the first liquid crystal cell 10. Accordingly, a desired video signal DB is transferred into the first liquid crystal cell 10 provided at the ith horizontal line.

As described above, in the embodiments of the present invention, a video signal is applied to the second liquid crystal cell 12 provided at the (i−1)th horizontal line during a time interval when the second gate signal SP2 is applied to the (i−1)th gate line GLi-1 and the first gate signal SP1 is applied to the ith gate line GLi, while a video signal is applied to the first liquid crystal cell 10 provided at the ith horizontal line during a time interval when the second and first gate signals SP2 and SP1 are turned off.

Figure 5:
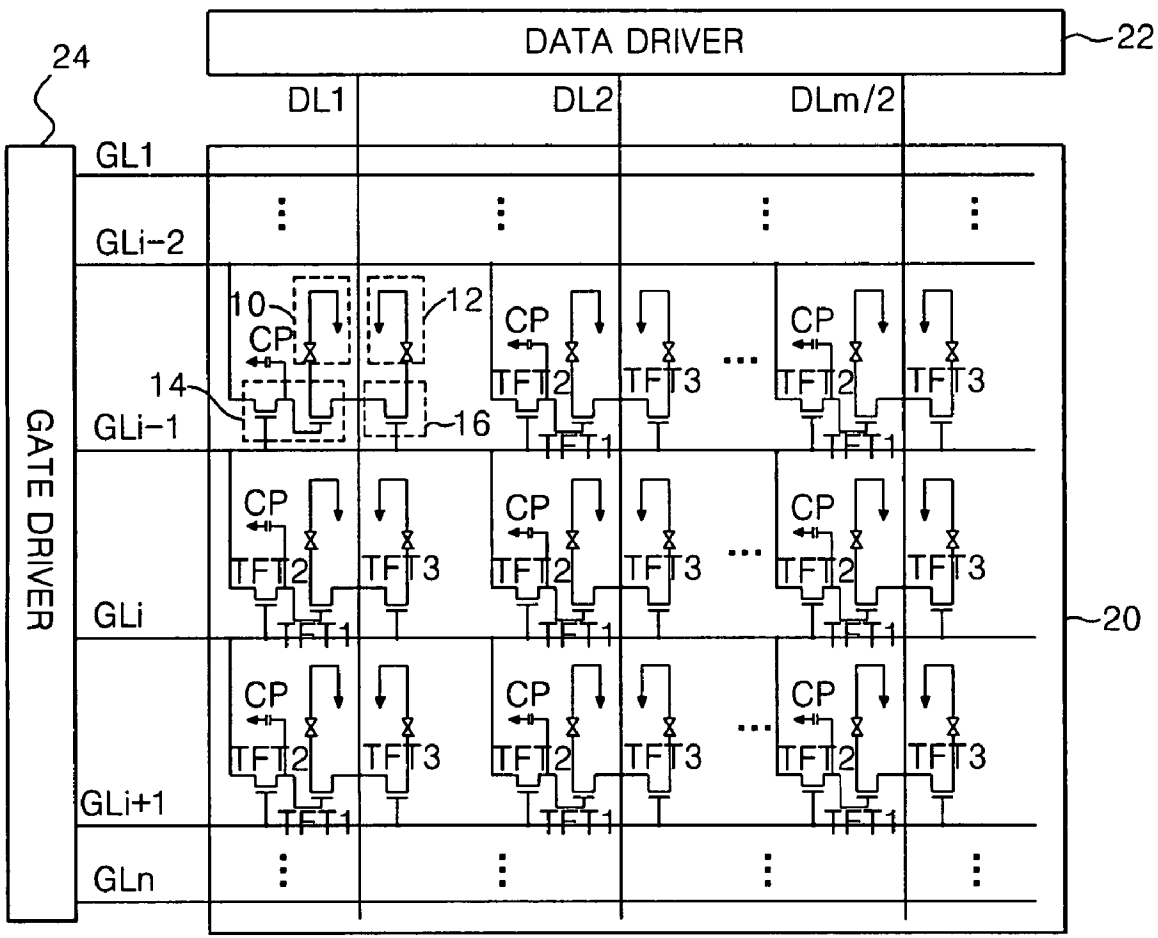
FIG. 5 is a block circuit diagram showing a configuration of a liquid crystal display according to a third embodiment.

In the third embodiment, a capacitor Cp may be connected to the gate terminal of the first thin film transistor TFT1 as shown in FIG. 5. Such a capacitor Cp charges to a value corresponding to the second gate signal SP2 applied to the previous gate line during the first period TA, and applies the second gate signal SP2 charged therein to the gate terminal of the first thin film transistor TFT1 during the second period TB, thereby allowing the first thin film transistor TFT1 to stably maintain an ON state during the second period TB. Since the other aspects of the third embodiment can be understood, for example, by the descriptions provided for the first and second embodiments, shown in FIGS. 2 and 4, a detailed explanation of the operation of this embodiment is not necessary for one skilled in the art.

Figure 6:
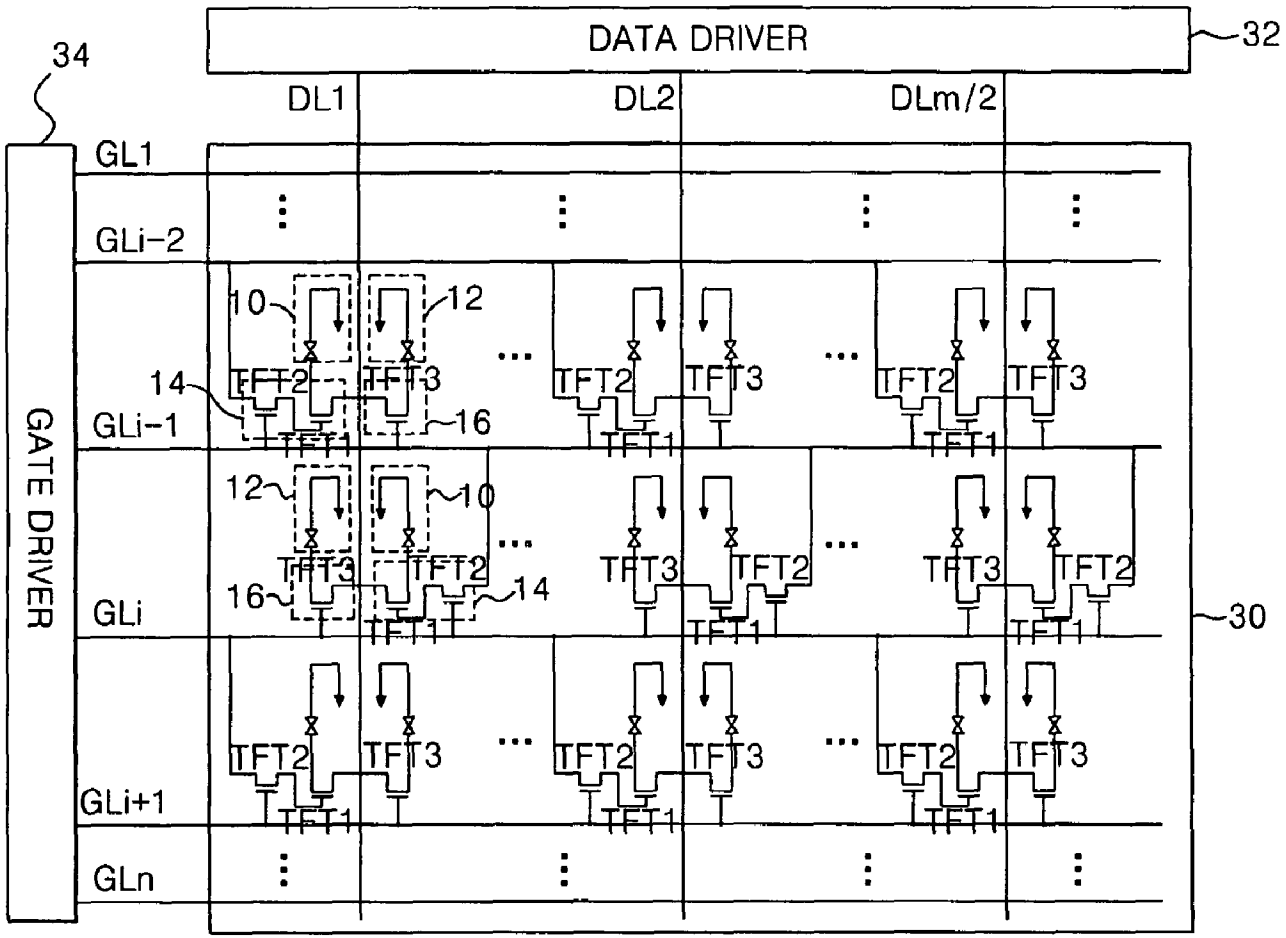
FIG. 6 is a block circuit diagram showing a configuration of a liquid crystal display according to a fourth embodiment.

FIG. 6 schematically shows a liquid crystal display (LCD) according to a fourth embodiment. Such a fourth embodiment has the same structure and function as the first embodiment shown in FIG. 2 except that locations of liquid crystal cells 10 and 12 and switching parts 14 and 16 have been altered.

Referring to FIG. 6, the LCD includes a liquid crystal display panel 30, a data driver 32 for driving data lines DL1 to DLm/2 of the liquid crystal display panel 30, and a gate driver 34 for driving gate lines GL1 to GLn of the liquid crystal display panel 30. The liquid crystal display panel 30 is comprised of first and second liquid crystal cells 10 and 12 provided in pairs at intersections between the gate lines GL1 to GLn and the data lines DL1 to DLm/2, with a first switching part 14 for driving the first liquid crystal cell 10, and a second switching part 16 for driving the second liquid crystal cell 12. In this embodiment, the first liquid crystal cell 10 and the first switching part 14 are arranged in a zigzag configuration on a basis of the data line DL with respect to the second liquid crystal cell 12 and the second switching part 16. That is, if the gate line GLi is considered as an odd numbered line, the first liquid crystal cell 10 and the first switching part 14 are located to the left of the data line at odd-numbered gate lines while the second liquid crystal cell 12 and the second switching part 16 are located to the right of the data line, as shown in FIG. 6. In even-numbered gate lines, the first liquid crystal cell 10 and the first switching part 14 are located at the right of the data line and the second liquid crystal cell 12 and the second switching part 16 are located at the left of the data line.

Figure 7:
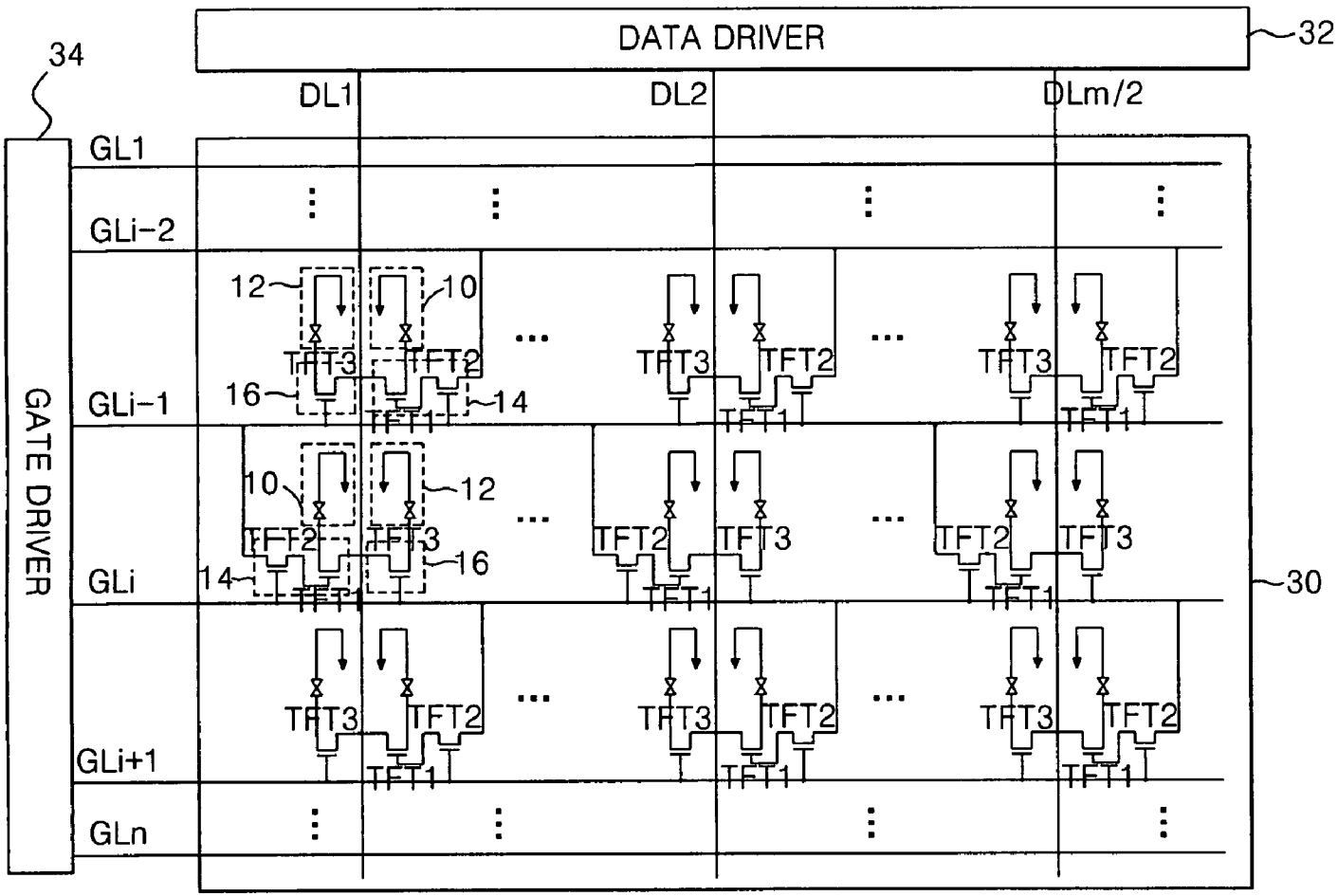
FIG. 7 is a block circuit diagram showing a configuration of a liquid crystal display according to a fifth embodiment.

Alternatively, according to a fifth embodiment, in the odd-numbered horizontal lines, the first liquid crystal cell 10 and the first switching part 14 may be located to the right of the data line the second liquid crystal cell 12 and the second switching part 16 may be located to the left of the data line, as shown in FIG. 7. In this case, in the even-numbered horizontal lines, the first liquid crystal cell 10 and the first switching part 14 are located to the left of the data line while the second liquid crystal cell 12 and the second switching part 16 are located to the right of the data line.

The first and second liquid crystal cells 10 and 12, arranged in a zigzag type on the basis of the data line DL in this manner, receive video signals from the adjacent data line DL. Thus, it becomes possible to reduce the number of data lines DL to a half in comparison to the related art LCD shown in FIG. 1.

The first switching part 14 for driving the first liquid crystal cell 10 includes first and second thin film transistors TFT1 and TFT2. The source terminal of the second thin film transistor TFT2 is connected to the (i−1)th gate line GLi-1 while the gate terminal thereof is connected to the ith gate line GLi. The gate terminal of the first thin film transistor TFT1 is connected to the drain terminal of the second thin film transistor TFT2 while the source terminal thereof is connected to the adjacent data line DL. Further, the drain terminal of the first thin film transistor TFT1 is connected to the first liquid crystal cell 10. Such a first switching part 14 applies a video signal to the first liquid crystal cell 10 when the gate terminal of the first thin film transistor TFT1 is at a floating state after having been charged with a voltage by the GLi-1 gate line.

The second switching part 16 for driving the second liquid crystal cell 12 includes a third thin film transistor TFT3. The gate terminal of the third thin film transistor TFT3 is connected to the ith gate line GLi while the source terminal thereof is connected to the adjacent data line DL. Further, the drain terminal of the third thin film transistor TFT3 is connected to the second liquid crystal cell 12. When a high driving signal is applied to the ith gate line GLi, the second switching part 16 applies a video signal which may be present on the data line DL to the second liquid crystal cell 12.

The gate driver 34 applies first and second gate signals SP1 and SP2 to each gate line GL1 to GLn, as shown in FIG. 3, in response to a control signal from the timing controller (not shown). Herein, the first gate signal SP1 maintains a high state during a time interval smaller than a ½ horizontal period (½)H while the second gate signal SP2 maintains a high state during the ½ horizontal period (½)H. Further, the second gate signal SP2 applied to the (i−1)th gate line GLi-1 is synchronous with, that is, rises at the same time as, the first gate signal SP1 being applied to the ith gate line GLi. Thus, the first gate signal SP1 applied to the ith gate line GLi transitions into a low state prior to the transition of the second gate signal SP2 applied to the (i−1)th gate line GLi-1.

The data driver 32 converts data R, G and B from the timing controller into analog video signals to thereby apply them to the data lines DL1 to DLm/2.

A procedure in which video signals may be applied to the liquid crystal cells 10 and 12 is described below.

First, during a first period TA (i.e., (½)H), the second gate signal SP2 is applied to the (i−1)th gate line GLi-1 and, simultaneously, the first gate signal SP1 is applied to the ith gate line GLi.

The first gate signal SP1 applied to the ith gate line GLi turns on the second and third thin film transistors TFT2 and TFT3 provided at the ith gate line. The second gate signal SP2 applied to the (i−1)th gate line GLi-1 turns on the first thin film transistor TFT1 via the second thin film transistor TFT2 provided at the ith horizontal line. Further, the second gate signal SP2 applied to the (i−1)th gate line GLi turns on the second and third thin film transistors TFT2 and TFT3 provided at the (i−1)th horizontal line.

The second gate signal SP2 is applied to the (i−1)th gate line GLi-1 and the first gate signal SP1 is applied to the ith gate line GLi, and the second liquid crystal cell 12 disposed at the (i−1)th horizontal line and connected to the data line DL. The second gate signal SP2 is applied to the (i−1)th gate line GLi-1 and the first gate signal SP1 is applied to the ith gate line GLi, and the first and second liquid crystal cell 10 and 12 disposed at the ith horizontal line are connected to the data line DL. A video signal DA to be applied to the second liquid crystal cell 12 disposed at the (i−1)th horizontal line is transferred onto the data line DL. Thus, a desired video signal DA is applied to the second liquid crystal cell 12 provided at the (i−1)th gate line. A video signal DA (dummy video signal) also is applied to the first and second liquid crystal cells 10 and 12 provided at the ith gate line.

During a second period TB (i.e., (½)H) following the first period TA, a gate signal is not applied to the gate lines GL. If a gate signal is not applied to the gate lines GL, then the second and third thin film transistors TFT2 and TFT3 provided at the ith horizontal line are turned off. The first thin film transistor TFT1 maintains an ON state which was established by the second gate signal SP2 applied in a previous (½)H period (i.e., the first period TA). That is, since the gate terminal of the first thin film transistor TFT1 is in a floating state after it had previously been supplied with the second gate signal SP2, the first thin film transistor TFT1 maintains an ON state during the second period TB (after the second thin film transistor TFT2 has been turned off). Since the first gate signal SP1 applied to the ith gate line GLi transitions into a low state prior to the second gate signal SP2 applied to the (i−1)th gate line GLi-1 transitioning into a low state, the gate terminal of the first thin film transistor TFT1 floated in the state to which it had been charged by the second gate signal SP2.

During the second period TB, a video signal DB to be applied to the first liquid crystal cell 10, provided at the ith horizontal line, is sent to the data line DL. Thus, the video signal DB, applied to the data line DL, is applied via the first thin film transistor TFT1 provided at the ith horizontal line, to the first liquid crystal cell 10. Accordingly, a desired video signal DB is transferred to the first liquid crystal cell 10 provided at the ith horizontal line.

As described in the above embodiments, a video signal is applied to the second liquid crystal cell 12 provided at the (i−1)th horizontal line during a time interval when the second gate signal SP2 is applied to the (i−1)th gate line GLi-1, and the first gate signal SP1 is applied to the ith gate line GLi while a video signal is applied to the first liquid crystal cell 10 provided at the ith horizontal line during a time interval when the second and first gate signals SP2 and SP1 are turned off.

Figure 8:
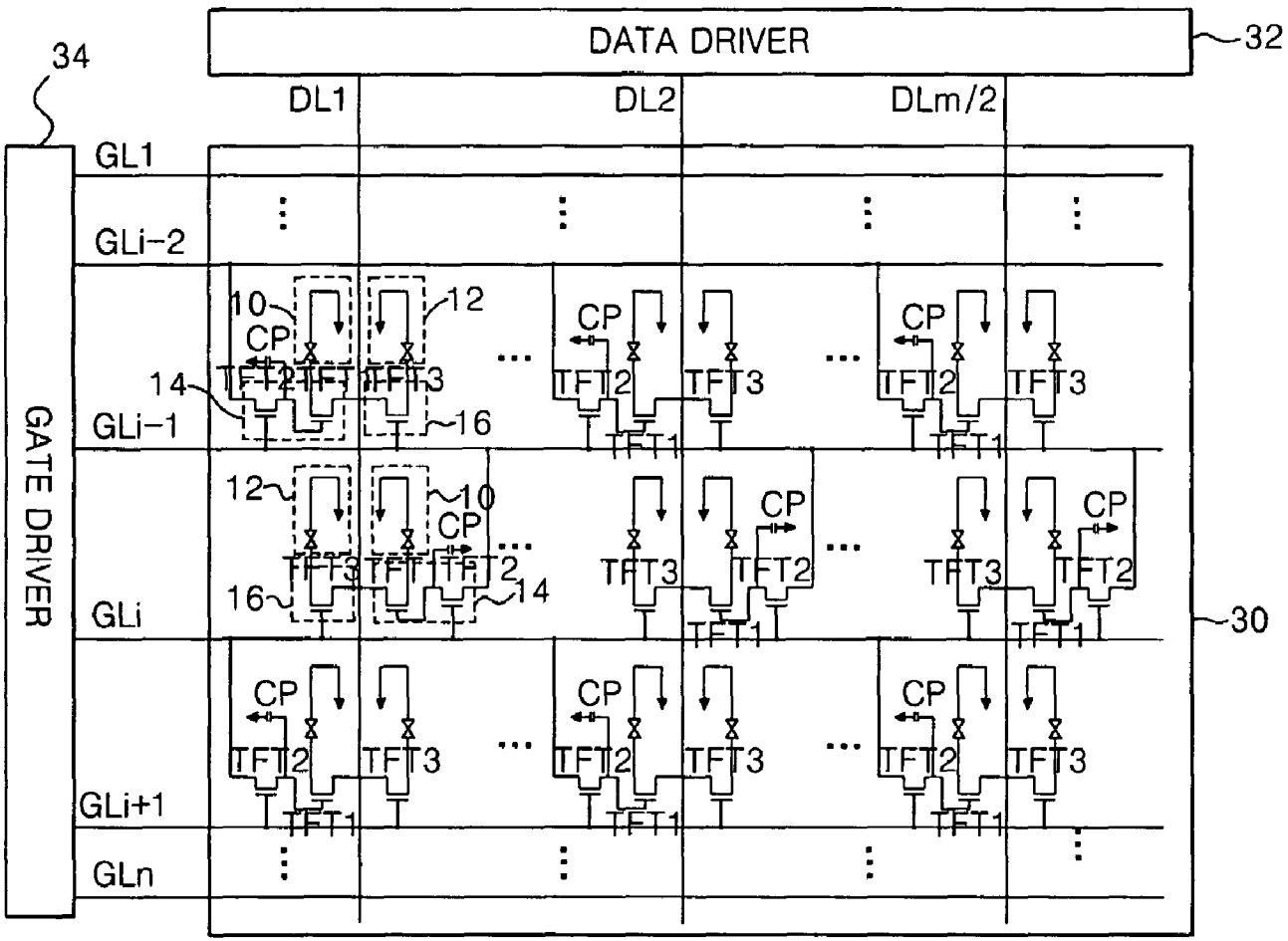
FIG. 8 is a block circuit diagram showing a configuration of a liquid crystal display according to a sixth embodiment.

Alternatively, in a sixth embodiment, a capacitor Cp is further provided to be connected to the gate terminal of the first thin film transistor TFT1 as shown in FIG. 8. Such a capacitor Cp may be charged by the second gate signal SP2 applied to the previous gate line during the first period TA and applies continues to apply a voltage corresponding to the second gate signal SP2 to the gate terminal of the first thin film transistor TFT1 during the second period TB, thereby allowing the first thin film transistor TFT1 to stably keep an ON state during the second period TB. The operating procedure in the sixth embodiment is analogous to that in the fourth embodiment shown in FIG. 6, and a detailed explanation as to this will be omitted.

In the fourth to sixth embodiments, the first and second liquid crystal cells 10 and 12 are arranged in a zigzag type, so that it becomes possible to display a picture having a uniform quality even though uniform voltages may not be charged in the first and second liquid crystal cells 10 and 12. For instance, even though a voltage higher than a desired voltage may be charged in the first liquid crystal cell 10 and a voltage lower than a desired voltage may be charged in the second liquid crystal cell 12, the first and second liquid crystal cells 10 and 12 are arranged in a zigzag type, so that a voltage difference can be effectively cancelled for each horizontal line to display a picture having a uniform quality.

As described above, a single data line drives the first and second liquid crystal cells positioned adjacently to each other at the left and right side of the data lines so that the number of data lines can be reduced. Accordingly, the number of data drive integrated circuits for applying driving signals to the data lines also can be reduced Furthermore, the first and second liquid crystal cells are arranged in a zigzag type, so that it becomes possible to display a picture having a uniform quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a plurality of data lines;

a plurality of gate lines arranged in a direction crossing the data lines;

a first liquid crystal cell disposed at a first side of each data line;

a second liquid crystal cell disposed at a second side of each data line;

a first switch to connect the first liquid crystal cell to a first data line; and a second switch to connect the second liquid crystal cell to the first data line, wherein the first switch is controlled by a gate signal on the (i−1)th gate line and the second switch is controlled by a gate signal on the ith gate line, wherein the first switch comprises:

a first switch element, a first terminal of the first switch element connected to the (i−1)th gate line (wherein i is an integer), and a second terminal of the first switch element connected to a third terminal of a second switch element, and a third terminal of the first switch element connected to the ith gate line; and the second switch element, a first terminal of the second switch element connected to the first data line, a second terminal of the second switch element connected to the first liquid crystal cell, and the third terminal of the second switch element connected to the second terminal of the second switch element.

2. The device according to claim 1, wherein the second switch comprises a switch element, a first terminal of the switch element connected to the first data line, the second terminal of the switch element connected to the second liquid crystal cell, and a third terminal of the switch element connected to the ith gate line.

3. The device according to claim 1, further comprising:

a gate driver for sequentially applying first and second gate signals to the gate lines such that the second gate signal applied to the (i−1)th gate line rises simultaneously with the first gate signal applied to the ith gate line.

4. The device according to claim 3, wherein the first gate signal has a smaller width than the second gate signal.

5. The device according to claim 1, wherein the first switch and the second switch positioned at the ith gate line are turned on when the first and second gate signals are applied to the (i−1)th and ith gate lines, and the third terminal of the second switch element is in a floating state when the first and second gate signals transition into a low state, thereby maintaining the second switch element in an ON state.

6. The device according to claim 5, wherein the second switch element connects the first data line and the first liquid crystal cell, when the second switch is in an ON state.

7. The device according to claim 5, further comprising:

a capacitor connected to the third terminal of the second switch element that permits the second switch element to stably remain in an ON state when the third terminal of the second switch element is in a floating state.

8. The device according to claim 5, wherein a desired video signal is applied to the first data line during a time when the third element of the second switch element is in the floating state, the video signal connected to the first liquid crystal cell by the second switch element.

9. The device according to claim 5, wherein a desired video signal is applied to the first data line during a time where the gate signals on the ith and the (i+1)th gate lines are present, the signal connected to the second liquid crystal cell by the second switch.

10. The device according to claim 1, wherein each liquid crystal cell is provided with a storage capacitor connected between a pixel electrode and a common electrode.

11. The device according to claim 1, wherein each liquid crystal cell is provided with a storage capacitor connected between a pixel electrode and a preceding gate line.

12. The device according to claim 1, wherein the first switch and the first liquid crystal cell are disposed to the left of the data line and the second switch and the second liquid crystal cell are disposed to the right of the data line.

13. The device according to claim 1, wherein the first switch and the first liquid crystal cell are disposed to the right of the data line and the second switch and the second liquid crystal cell are disposed to the left of the first data line.

14. The device according to claim 1, wherein in alternating horizontal lines, the first switch and the first liquid crystal cell are disposed to the left of the first data line and the second switch and the second liquid crystal cell are disposed to the right of the first data line, and the first switch and the first liquid crystal cell are disposed to the right of the first data line and the second switch and the second liquid crystal cell are disposed to the left of the first data line.

15. The device according to claim 1, wherein the first liquid crystal cell and the second liquid cell are disposed at intersections of the data lines and gate lines.

16. The liquid crystal display device according to claim 1, wherein, in even-numbered gate lines, the first liquid crystal cell and the first switch are located at a left side of the first data line and the second liquid crystal cell and the second switch are located a right side of the first data line, and in odd-numbered gate lines, the first liquid crystal cell and the first switch are located at the right side of the first data line while the second liquid crystal cell and the second switch are located at the left side of the first data line.

17. The liquid crystal display device according to claim 1, wherein, in odd-numbered gate lines, the first liquid crystal cell and the first switch are located at a left side of the first data line and the second liquid crystal cell and the second switch are located at a right side of the first data line, and in even-numbered gate lines, the first liquid crystal cell and the first switch are located at the right side of the first data line and the second liquid crystal cell and the second switch are located at the left side of the first data line.

* * * * *

UNITED STATES PATENT AND TRADEMARK OFFICE

CERTIFICATE OF CORRECTION

PATENT NO. : 7,535,445 B2
APPLICATION NO. : 10/988906
DATED : May 19, 2009
INVENTOR(S) : Yong Ho Jang It is certified that error appears in the above-identified patent and that said Letters Patent is hereby corrected as shown below:

In the Claims

In column 10, claim 1, line 17, after "first side of" replace "each" with --a first--.

In column 10, claim 1, line 20, before "data line" replace "each" with --the first--.

In column 10, claim 1, line 21, after "crystal cell to" replace "a" with --the--.

In column 11, claim 12, line 21, before "data line and the" insert --first--.

In column 11, claim 12, line 22, after "to the right of the" insert --first--.

In column 11, claim 13, line 25, before "data line and the second" insert --first--.

In column 12, claim 16, line 14, before "a right side of" insert --at--.

Signed and Sealed this

Twenty-fourth Day of November, 2009

David J. Kappos

David J. Kappos
*Director of the United States Patent and Trademark Office*